US012702898B2

(12) United States Patent
Pouchet et al.

(10) Patent No.: US 12,702,898 B2
(45) Date of Patent: Aug. 11, 2026

(54) GOLF BALL RECOVERY SYSTEMS, APPARATUS, AND METHODS

(71) Applicant: Mulligan International Inc., Beloeil (CA)

(72) Inventors: Maxime Pouchet, Beloeil (CA); Mikael Pouchet, Beloeil (CA); François Pouchet, Beloeil (CA)

(73) Assignee: Mulligan International Inc., Beloeil (CA)

( * ) Notice: Subject to any disclaimer, the term of this patent is extended or adjusted under 35 U.S.C. 154(b) by 415 days.

(21) Appl. No.: 18/225,989

(22) Filed: Jul. 25, 2023

(65) Prior Publication Data

US 2024/0058655 A1 Feb. 22, 2024

Related U.S. Application Data

(60) Provisional application No. 63/398,268, filed on Aug. 16, 2022.

(51) Int. Cl.
*A63B 47/02* (2006.01)

(52) U.S. Cl.
CPC ..... *A63B 47/021* (2013.01)

(58) Field of Classification Search
CPC ..... A63B 47/021; A63B 2047/022
See application file for complete search history.

(56) References Cited

U.S. PATENT DOCUMENTS 3,102,647 A * 9/1963 Bonney ..... A63B 47/021 414/440
3,175,714 A * 3/1965 Wittek ..... A63B 47/021 280/411.1
3,995,759 A * 12/1976 Hollrock ..... A01D 51/00 414/440
4,158,418 A * 6/1979 Hayashi ..... A63B 47/021 414/440
5,087,165 A 2/1992 Akel
5,141,383 A * 8/1992 Phillips ..... A63B 47/021 414/440
5,332,350 A * 7/1994 Hollrock ..... A63B 47/04 414/376
5,527,075 A * 6/1996 Jones ..... A63B 47/021 294/19.2
5,678,805 A * 10/1997 Moser ..... B66D 1/26 414/440

(Continued)

FOREIGN PATENT DOCUMENTS

WO 2022/113303 A1 6/2022

OTHER PUBLICATIONS

International Search Report of corresponding PCT application No. PCT/CA2023/050995 mailed Oct. 19, 2023.

*Primary Examiner* — Jonathan Snelting

(57) ABSTRACT

Systems, apparatus and methods for recovering golf balls from a surface at the bottom of a body of water are described. The systems and apparatus comprise a picking assembly configured to pick golf balls from a surface when moved along the surface and a docking module configured to receive the picking assembly and to remove the golf balls therefrom. By repeatedly dragging the picking assembly across the surface between progressively changing points on either side of the surface, it is possible to recover golf balls from the entire surface.

17 Claims, 11 Drawing Sheets

(56) References Cited

U.S. PATENT DOCUMENTS

| | | | | |
|---|---|---|---|---|
| 5,882,169 | A * | 3/1999 | Tucek | A63B 47/021 414/440 |
| 7,462,010 | B1 * | 12/2008 | Wittek, Jr. | A63B 47/021 414/338 |
| 8,920,101 | B2 * | 12/2014 | Leyco | A63B 47/021 414/439 |
| 2005/0204717 | A1 | 9/2005 | Colens | |
| 2006/0125256 | A1 | 6/2006 | Hiland et al. | |
| 2010/0250024 | A1 | 9/2010 | Macedo Ribeiro et al. | |
| 2015/0190683 | A1 | 7/2015 | Morgan | |
| 2020/0070015 | A1 | 3/2020 | Zhang | |
| 2022/0062717 | A1 | 3/2022 | Kidder | |
| 2023/0381600 | A1 * | 11/2023 | Inaba | A63B 47/021 |

* cited by examiner

GOLF BALL RECOVERY SYSTEMS, APPARATUS, AND METHODS

CROSS-REFERENCE TO PREVIOUS APPLICATION

This application claims priority from U.S. provisional patent application No. 63/398,268 filed on Aug. 16, 2022, which is incorporated herein by reference in its entirety.

FIELD

The present disclosure generally relates to the field of golf course operation and maintenance. In particular, various embodiments are described herein that generally relate to golf ball recovery systems, apparatus and methods.

INTRODUCTION

The following paragraphs are provided by way of background to the present disclosure. They are not, however, an admission that anything discussed therein is prior art or part of the knowledge of persons skilled in the art.

Golf courses usually have areas that are difficult to access by the golfer or inaccessible to the golfer, like a water hazard, pond, or lake. Golf course operators and others have found ways to retrieve golf balls from these inaccessible areas so that they can be reused or sold.

Early golf ball retrievers include the Golf Ball Retriever described in U.S. Pat. No. 5,087,165. The retriever makes use of spaced generally rigid disc members mounted on an axle. The disc members have a diameter less than the diameter of the wheels of the retriever so that the outer edges of the disc members do not engage the ground. Spaced, stationary elongated fingers have fixed ends connected to the frame of the retriever and free ends extending inwardly in the spaces between adjacent disc members. The fingers strip the balls from between the adjacent disc members. The retriever is a device that is operated by hand where removal of the balls occurs within the device.

Another golf ball retriever is the Golf Ball Picker and Power Drive Device for Moving the Picker described in U.S. Pat. No. 5,678,805. The retrieving system includes a power drive device which is stationed along the shore of the submerged surface of a golf course water hazard and which carries a pair of spools on which a flexible line is wound. The flexible line on one spool is connected directly to a golf ball retrieving mechanism, and the line from the other spool is connected around a pulley on a stake on the opposite side of the submerged surface and is then connected to the golf ball retrieving device. The golf ball retriever is moved along the submerged surface toward and away from the opposite shores of the water hazard by alternatively driving one of the spools and permitting the other spool to unwind. The power drive device is moved incrementally along the shore surface after each sweep of the golf ball retriever so that golf balls may be retrieved from all of the submerged surface. The retriever is a system that is operated by a power drive device where removal of the balls is done by hand.

There is a need for a golf ball recovery system, apparatus and method that addresses the challenges and/or shortcomings described above.

SUMMARY

Various embodiments of a golf ball recovery system, apparatus, and method are provided according to the teachings herein.

According to an aspect of the present disclosure, there is disclosed a system for recovering golf balls. The system comprises a picking assembly configured to pick golf balls from a surface when moved along the surface and a docking module configured to receive the picking assembly and to remove the golf balls therefrom.

In some examples, the docking module is further arranged to collect golf balls that have been removed from the picking assembly.

In some examples, the picking assembly comprises an axle having mounted thereon a plurality of resilient discs spaced apart from one another so as to allow the golf balls to be wedged between adjacent discs.

In some examples, the docking module comprises a plurality of dislodging fingers, each dislodging finger engaging a space between adjacent resilient discs when the picking assembly is received within the docking module, the dislodging fingers being configured to remove the golf balls that are wedged between the adjacent resilient discs when the picking assembly and the dislodging fingers are rotated relative to each other around the axle.

In some examples, the docking module further comprises one or more driving rollers configured to rotatably engage the picking assembly, thereby rotating the picking assembly relative to the dislodging fingers.

In some examples, the docking module is configured to momentarily increase the distance between the plurality of resilient discs when the picking assembly is rotated in the docking module in order to remove the golf balls from therebetween.

In some examples, the system for recovering golf balls further comprises a winch configured to pull a first cable attached to the picking assembly so as to move the picking assembly along the surface and to pull the picking assembly into a received position within the docking module.

In some examples, the system for recovering golf balls further comprises a ball receptacle for storing the golf balls that are collected from the picking assembly by the docking module.

In some examples, the system for recovering golf balls further comprises an attachment member on the docking module to attach to a vehicle configured to transport the docking module In some examples, the system for recovering golf balls further comprises a vehicle configured to transport the docking module.

In some examples, the system for recovering golf balls further comprises a counter-action device configured to pull a second cable attached to the picking assembly so as to move the picking assembly along the surface and to pull the picking assembly away from the docking module.

In some examples, the counter-action device comprises a vehicle with a winch mounted thereon to winch the second cable away from the docking module.

In some examples, the first and second cables are different portions of the same cable.

In accordance with another aspect of the present disclosure, there is provided apparatus for removing golf balls from a picking assembly configured to pick the golf balls from a surface when moved along the surface. The picking assembly comprising an axle having mounted thereon a plurality of resilient discs spaced apart from one another so as to allow the golf balls to be wedged between adjacent discs, The apparatus comprises a docking module configured to receive the picking assembly and to remove the golf balls therefrom.

In some examples, the docking module comprises a plurality of dislodging fingers, each dislodging finger engaging a space between adjacent resilient discs when the picking assembly is received within the docking module, the dislodging fingers being configured to remove the golf balls that are wedged between the adjacent resilient discs when the picking assembly and the dislodging fingers are rotated relative to each other around the axle.

In some examples, the docking module is configured to momentarily increase the distance between the plurality of resilient discs when the picking assembly is rotated in the docking module in order to remove the golf balls from therebetween.

In some examples, the apparatus further comprises one or more driving rollers configured to rotatably engage the picking assembly, allowing rotation of the picking assembly relative to the dislodging fingers.

In some examples, the apparatus further comprises a winch configured to pull a cable attached to the picking assembly so as to move the picking assembly along the surface and to pull the picking assembly into a received position within the docking module.

In some examples, the apparatus further comprises a ball receptacle for storing the golf balls that are collected from the picking assembly by the docking module.

In accordance with yet another aspect of the present disclosure, there is provided a vehicle having an apparatus in accordance with the above attached thereto.

In accordance with yet another aspect of the present disclosure, there is provided a method of recovering golf balls from a surface. The method comprises providing a system for recovering golf balls including a picking assembly configured to pick the golf balls from the surface when moved along the surface and a docking module configured to receive the picking assembly and to remove the golf balls therefrom, the system having two endpoints between which the picking assembly is operable to travel. The method also comprises positioning the system endpoints between a pair of geographic points on sides of the surface. The method also comprises dragging the picking assembly across the surface between the two endpoints using a pulling cable. The method also comprises pulling the picking assembly into the docking module using the cable. The method also comprises removing any golf balls collected using the docking module.

In some examples, the method further comprises repeating the steps of positioning, dragging, pulling and removing between different pairs of geographic points on sides of the surface until the picking assembly has been dragged across substantially the entire surface.

In some examples, the surface is the bed of a body of water.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein. In the drawings.

Figure 1:
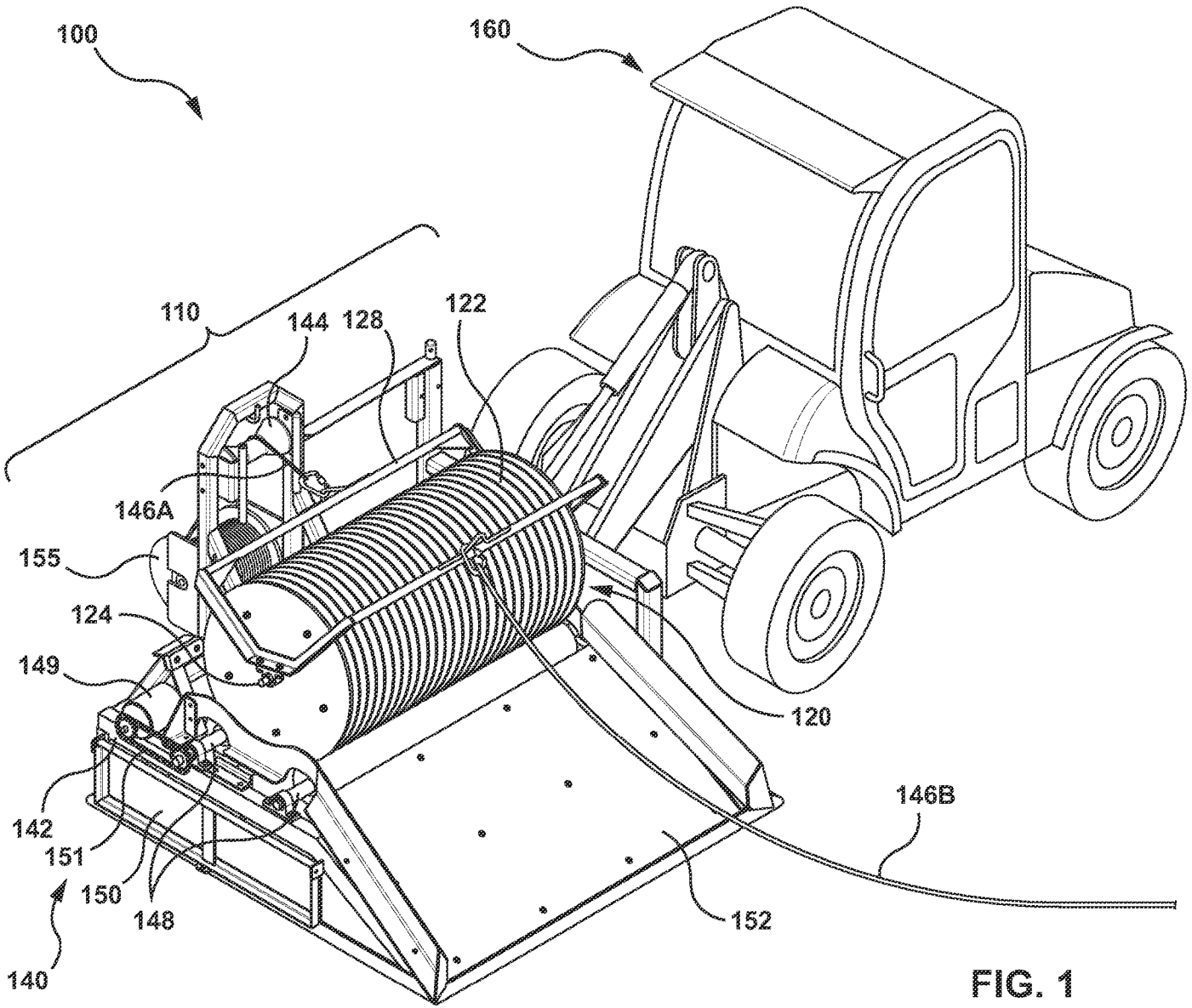
FIG. 1 shows a perspective view of an example embodiment of part of a golf ball recovery system in accordance with the present disclosure.
Figure 8A:
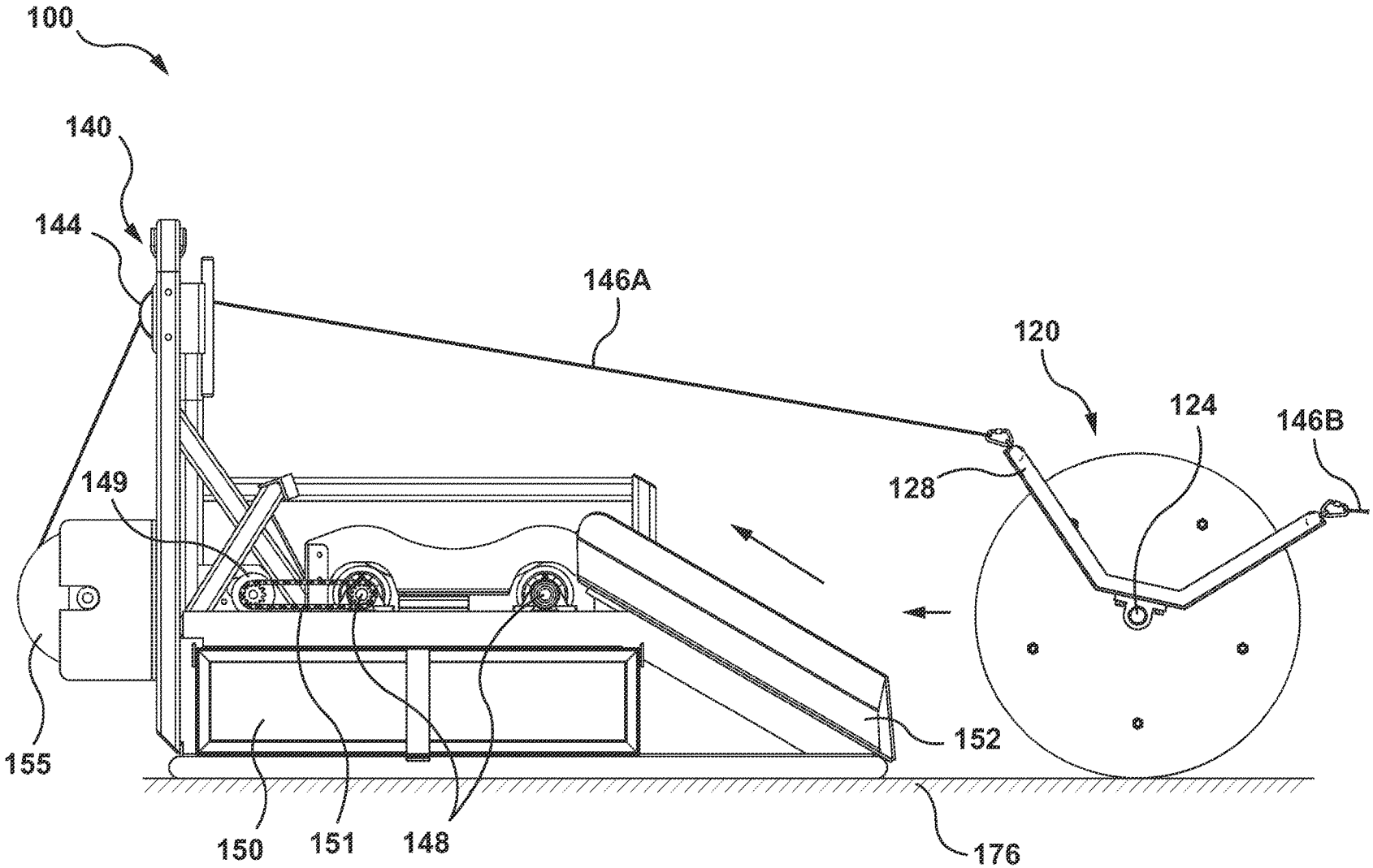
Figure 8B:
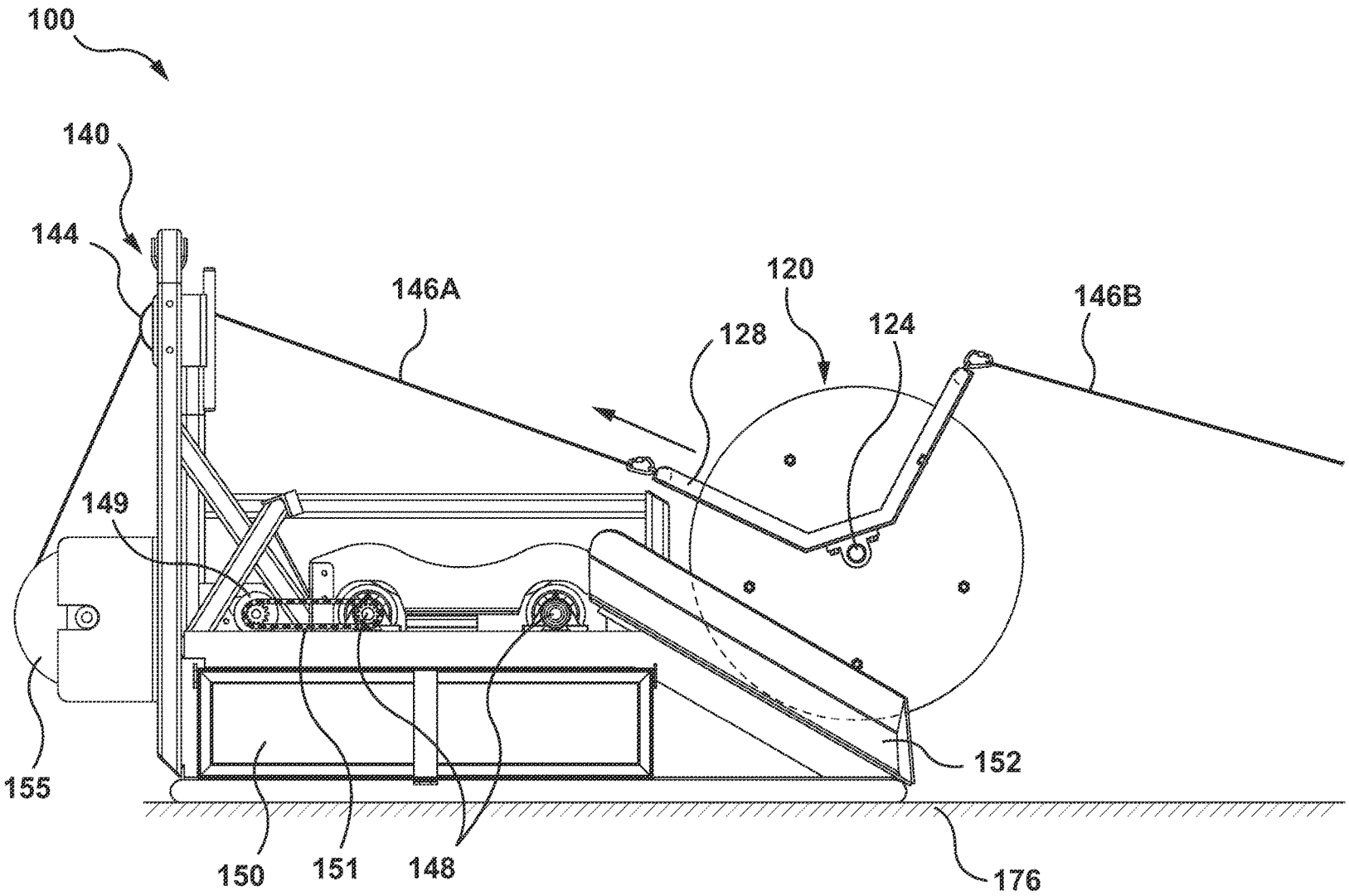
Figure 8C:
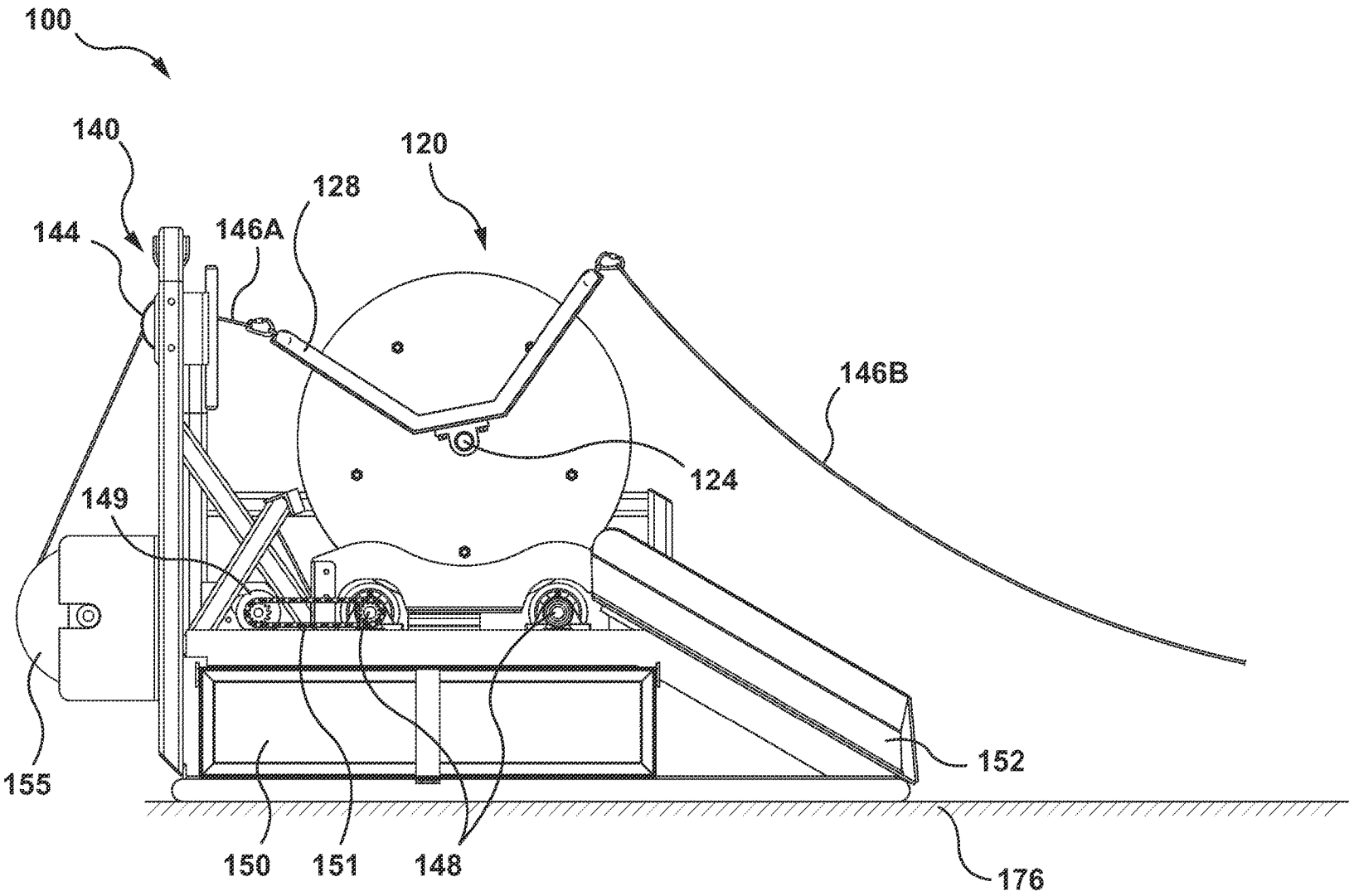
Figure 9:
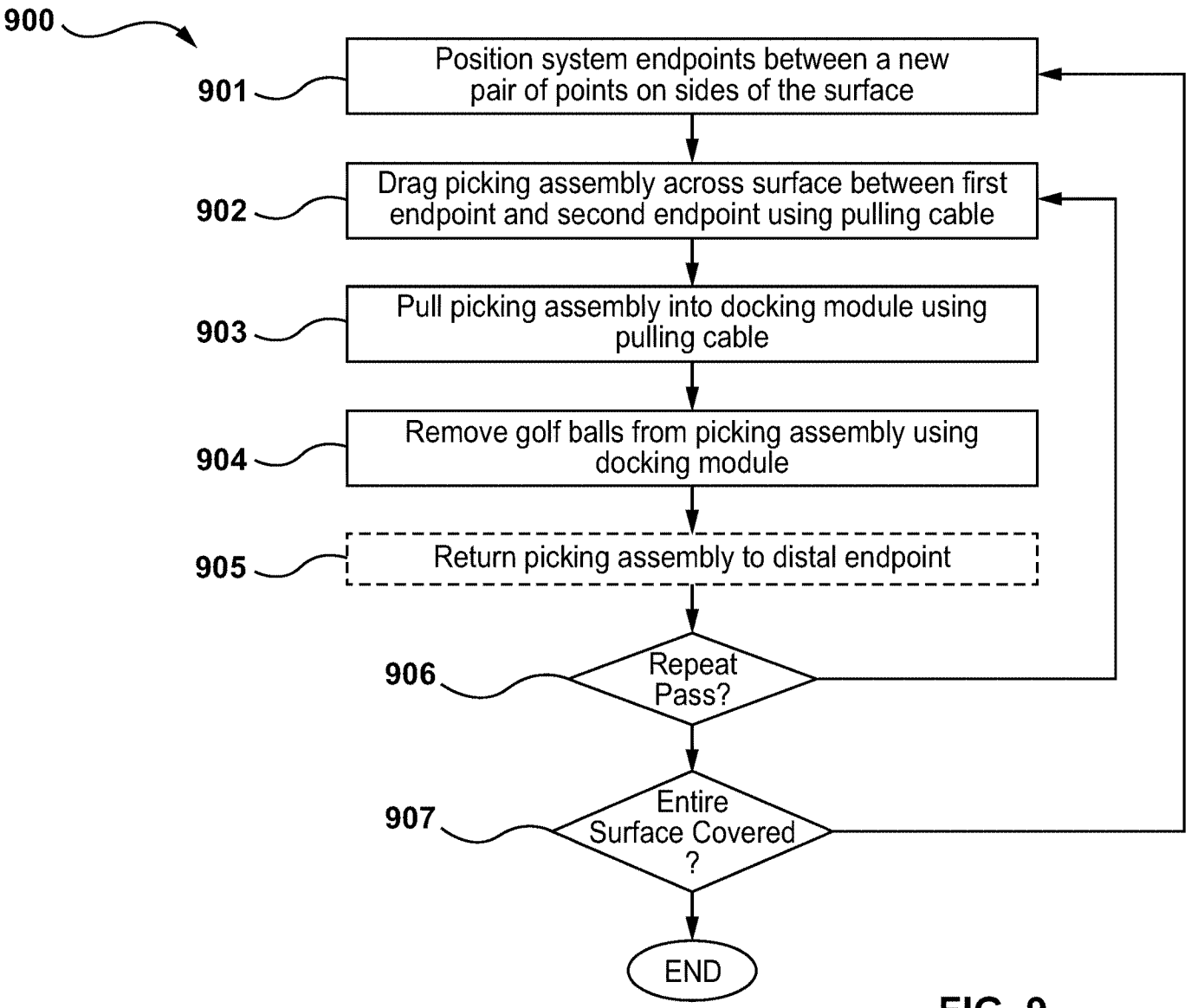

FIGS. 8A-8C show a side view of an example embodiment of the golf ball recovery system of FIG. 1 in use, showing the picking assembly being pulled across a surface, the picking assembly being pulled up a ramp towards the docking module, and the picking assembly settling into a received position within the docking module; and FIG. 9 shows a flowchart illustrating an example of a method for recovering golf balls from a surface using the golf ball recovery system of FIG. 1.

Further aspects and features of the example embodiments described herein will appear from the following description taken together with the accompanying drawings.

DESCRIPTION OF VARIOUS EMBODIMENTS

Various embodiments in accordance with the teachings herein will be described below to provide an example of at least one embodiment of the claimed subject matter. No embodiment described herein limits any claimed subject matter. The claimed subject matter is not limited to devices, systems, or methods having all of the features of any one of the devices, systems, or methods described below or to features common to multiple or all of the devices, systems, or methods described herein. It is possible that there may be a device, system, or method described herein that is not an embodiment of any claimed subject matter. Any subject matter that is described herein that is not claimed in this document may be the subject matter of another protective instrument, for example, a continuing patent application, and the applicants, inventors, or owners do not intend to abandon, disclaim, or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures, and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical or electrical connotation. For example, as used herein, the terms coupled or coupling can indicate that two elements or devices can be directly connected to one another or connected to one another through one or more intermediate elements or devices via an electrical signal, electrical connection, or a mechanical element depending on the particular context.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5%, or 10%, for example, if this deviation does not negate the meaning of the term it modifies.

Furthermore, the recitation of numerical ranges by endpoints herein includes all numbers and fractions subsumed within that range (e.g., 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Some elements herein may be identified by a part number, which is composed of a base number followed by an alphabetical or numerical suffix (e.g., 184A, or 184$_1$). Multiple elements herein may be identified by part numbers that share a base number in common and that differ by their suffixes (e.g., 184$_1$, 184$_2$, and 184$_3$). All elements with a common base number may be referred to collectively or generically using the base number without a suffix (e.g., 184).

In accordance with the teachings herein, there are provided various embodiments for a golf ball recovery system, apparatus, and method.

The present disclosure relates to a golf ball recovery systems, apparatus, and methods. More particularly, in some examples, the golf ball recovery system provides a means for picking up golf balls in lakes and ponds in such a manner as to make the process more efficient, effective, and/or safe. The system employs ball-picking rollers (or "driving rollers") in order to accomplish its task.

Reference is first made to FIG. 1, showing a perspective view of an example embodiment of a system 100 for golf ball recovery. System 100 includes a picking assembly 120 and a docking module 140. Picking assembly 120 is configured to pick golf balls from a surface S when moved along surface S. Docking module 140 is configured to pull picking assembly 120 along surface S, receive picking assembly 120 and remove golf balls therefrom. FIG. 1 shows picking assembly 120 docked in (e.g., sitting on) docking module 140, which together may be referred to as the docked configuration 110. The system 100 may include a vehicle 160 capable of transporting docking module 140 on its own or the docked configuration 110. FIG. 1 shows the docked configuration 110 attached to vehicle 160. Vehicle 160 may be an all-terrain vehicle (ATV), such as a Bobcat. In other embodiments, vehicle 160 can be any other type of suitable vehicle including, but not limited to, a tractor or other agricultural vehicle and/or construction vehicle, a truck, car or ATV attached to a trailer upon which is mounted docking module 140, or any other suitable vehicle capable of transporting docking module 140.

System 100 may have controls (e.g., a joystick, buttons, levers) to operate different parts of docking module 140. The controls may be located, for example, in vehicle 160. In other embodiments, the controls may be located directly on docking module 140. Alternatively, or in addition, in some embodiments, system 100 may be controlled remotely, by way of a dedicated hardware remote control, or by way of an application (i.e., an "app") running on a communication device such as a smartphone or tablet.

Alternatively, or in addition, system 100 and vehicle 160 may operate autonomously or semi autonomously and may include a Global Positioning System (GPS) module and an autonomous navigation module capable of, for example, carrying out the method of FIG. 9.

Figure 2:
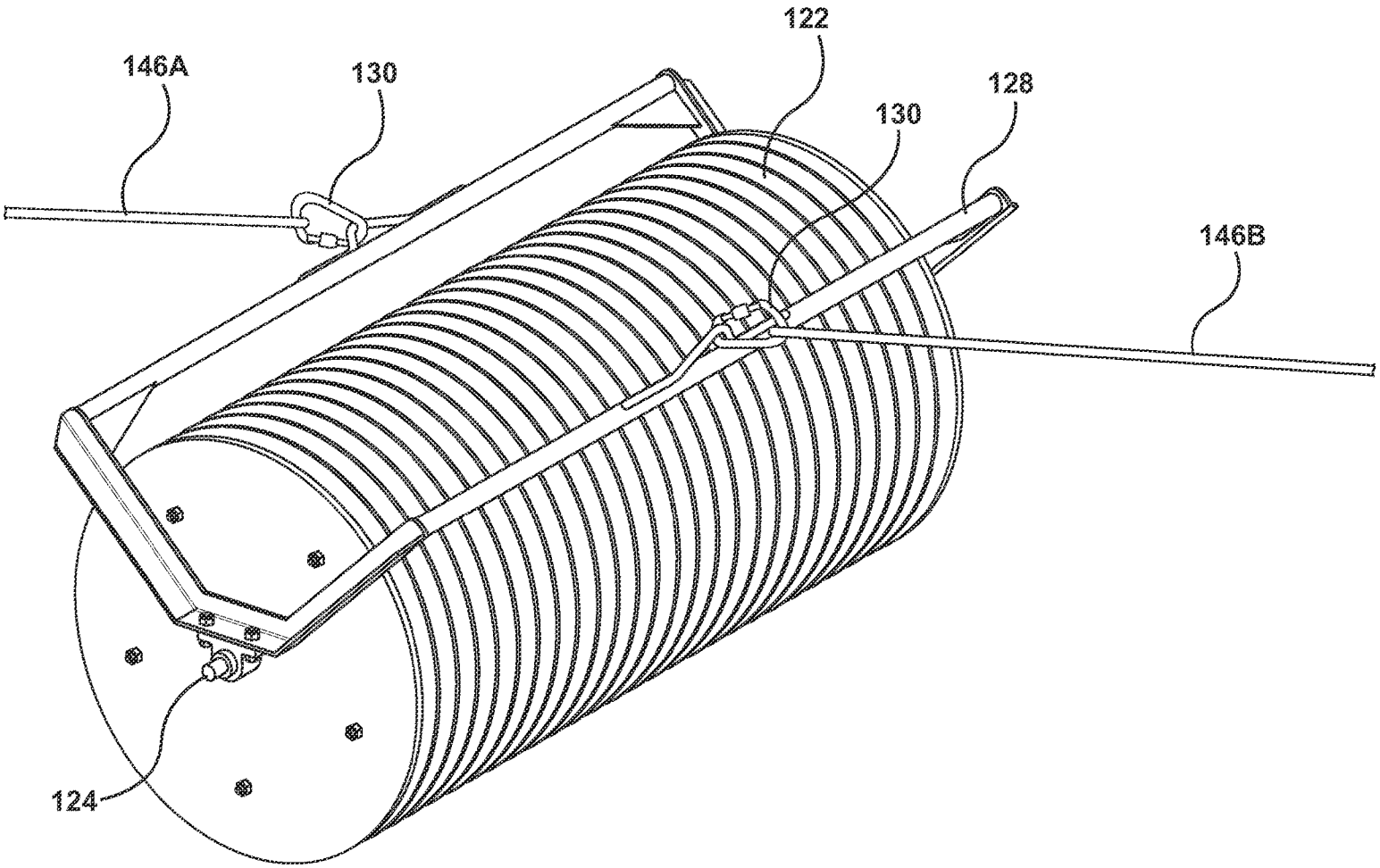
FIG. 2 shows a perspective view of an example embodiment of the picking assembly of the system shown in FIG. 1.

FIG. 2 shows a perspective view of an example embodiment of picking assembly 120 of FIG. 1. Picking assembly 120 (or "ball pick-up roller") has an axle 124 having mounted thereon a plurality of resilient discs 122. Resilient discs 122 are mounted on axle 124 and spaced apart from one another so as to allow golf balls to be wedged between adjacent resilient discs 122.

Picking assembly 120 may be coupled to docking module 140 by a pulling cable 146A. For example, pulling cable 146A may have one end with a loop that is inserted into a carabiner 130 that is connected to a towing bar 128 of picking assembly 120. Alternatively, pulling cable 146A may be attached to towing bar 128 by any other suitable means including, but not limited to, shackles, knots, etc.

Pulling cable 146A may have a length sufficient to allow picking assembly 120 to traverse along a desired length of surface S, such as 600 feet to 1000 feet. The pulling cable 134 may be made of a material sufficiently strong to pull the full weight of picking assembly 120 through water and along the bed of a body of water, such as a synthetic winch rope (e.g., made of hi-tech polyethylene), stainless steel, or any other suitable material.

The required spacing between adjacent resilient discs 122 will depend on the dimensions of golf balls 174 being picked and the thickness of resilient discs 122. Typical spacing can range between 1.5" and 2". In some embodiment, the spacing may be, for example, 1.75"; other spacing (e.g., more or less than 1.75") may be used depending on the thickness of each of resilient discs 122. Resilient discs 122 may have a diameter suitable for rolling across a desired surface, such as, for example, 28 inches. As will be appreciated by the skilled reader, the radii of resilient discs 122, the thickness of resilient discs 122, the spacing between resilient discs 122 and all corresponding dimensions of docking module 140 (e.g., the thickness, length and/or spacing between dislodging fingers 154) can be altered depending on the material used for the disc and the size of the balls being picked.

Figure 3:
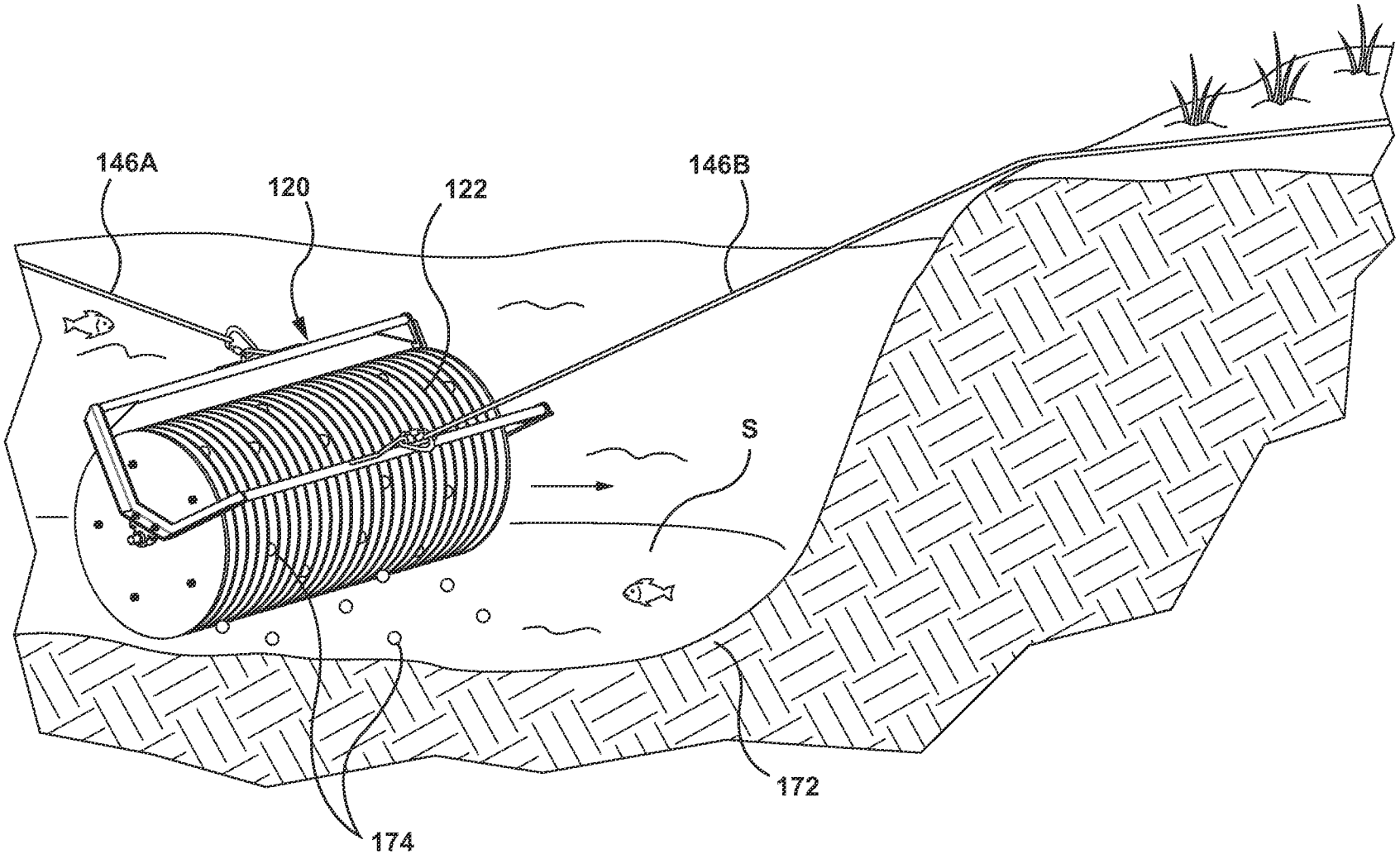
FIG. 3 shows a perspective view of an example embodiment of the picking assembly of FIG. 2 while being dragged across a surface using pulling cables.

FIG. 3 shows a perspective view of an example embodiment of picking assembly 120 of FIG. 1 while being dragged across a surface S using pulling cable 146B. Surface S may be a bed of a body of water on which golf balls 174 are resting and may be composed of a variety of surface materials 172, such as, for example, any combination of mud, silt, clay, rock, pebbles, and vegetation. While in use, picking assembly 120 can retrieve golf balls 174 from material 172 of surface S. Golf balls 174 that are retrieved are wedged between adjacent resilient discs 122. As shown on FIG. 3, picking assembly 120 can be dragged across surface S in multiple directions by alternatively using pulling cable 146A and pulling cable 146B, as will be described in more detail elsewhere herein.

Figure 4:
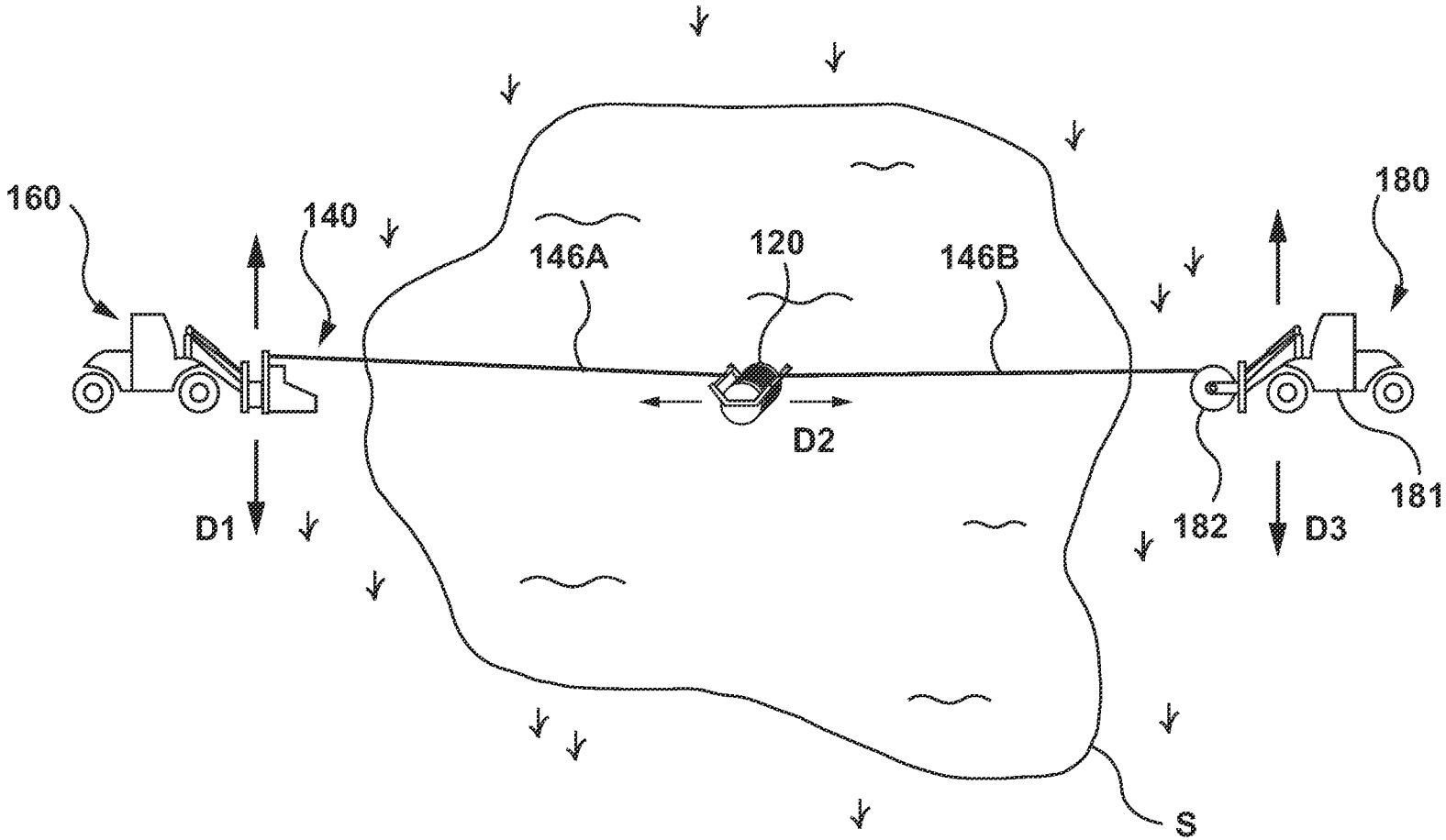
FIG. 4 shows a schematic diagram of the system of FIG. 1 in operation in accordance with the method of FIG. 8.

FIG. 4 shows a schematic drawing of an example embodiment of system 100 of FIG. 1 while being dragged across a surface S. In the embodiment shown in FIG. 4, system 100 comprises vehicle 160, docking module 140, picking assembly 120, as well as a remote counter-action device 180. In some embodiments, remote counter-action device 180 is a pulley around which is threaded pulling cable 146B, with one end of pulling cable 146B being connected to picking assembly 120 and the other end of pulling cable 146B being connected to, for example, a second winch (not shown) on docking module 140. In the embodiments shown in FIG. 4, remote counter-action device 180 comprises a winch 182 mounted on a vehicle 181. The vehicle 181 may be an all-terrain vehicle (ATV), such as a Bobcat. In other embodiments, vehicle 181 can be any other type of suitable vehicle including, but not limited to, a tractor or other agricultural vehicle and/or construction vehicle, a truck, car or ATV attached to a trailer upon which is mounted winch 182, or any other suitable vehicle capable of transporting and positioning winch 182. As will be appreciated by the skilled person, pulling cable 146A and 146B can, in some embodiments, two different portions of the same cable.

As can be seen from FIG. 4, by successive operation of winches 182 and 155, as described in more detail elsewhere herein, picking assembly 120 may be moved alternatively along the directions shown in FIG. 4 as D2. Moreover, by combining this displacement with coordinated displacement of vehicles 160 and 181 along the directions shown in FIG. 4 as D1 and D3, respectively, it is possible for the system to drag picking assembly 120 across the entirety of surface S, as described in more detail with reference to the method of FIG. 9.

Figure 5:
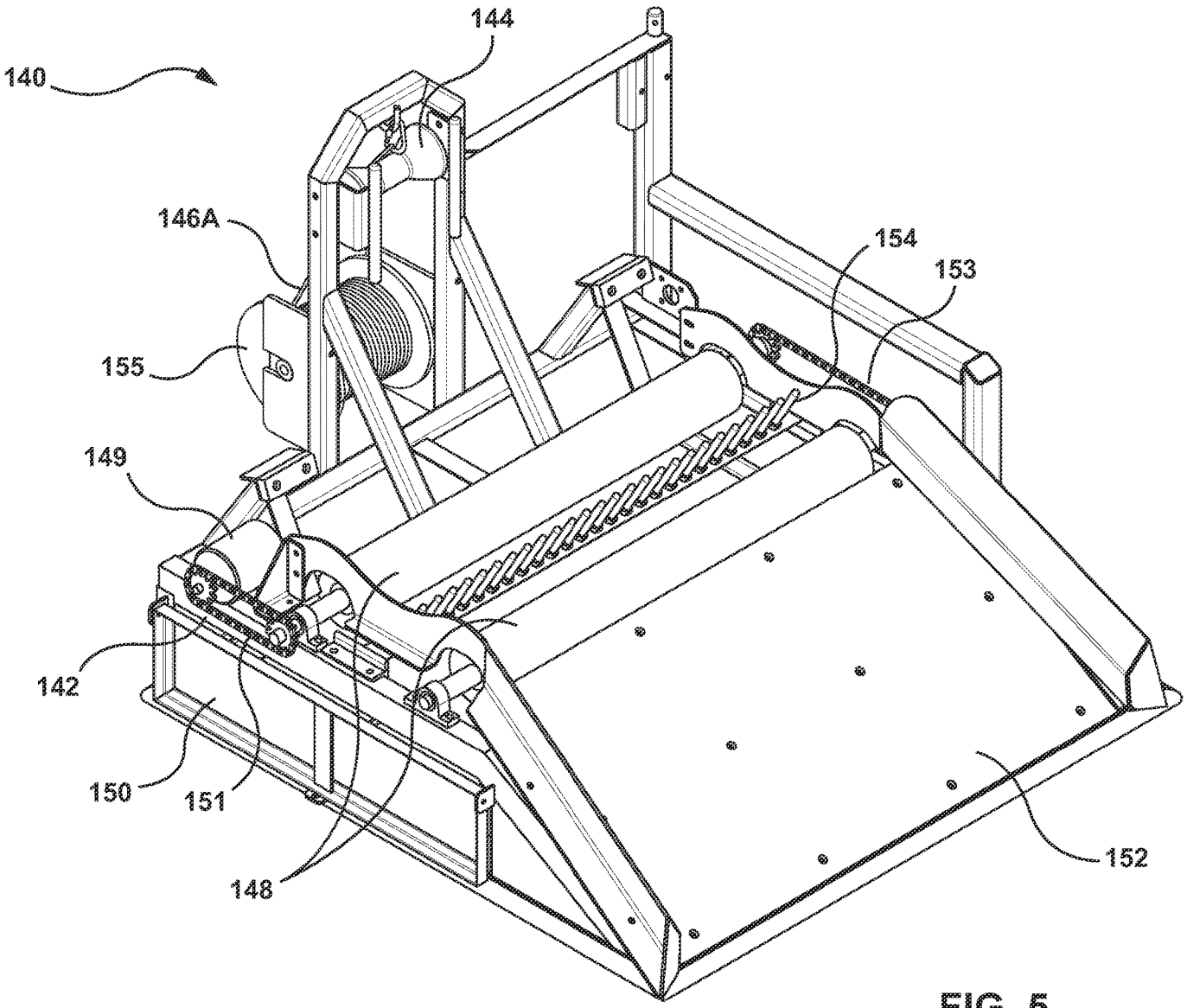
FIG. 5 shows a perspective view of an example embodiment of the docking module of the system shown FIG. 1.

FIG. 5 shows a perspective view of an example embodiment of docking module 140 of FIG. 1. Docking module 140 includes a plurality of dislodging fingers 154 that are positioned so that each dislodging finger 154 can engage a space between adjacent resilient discs 122 when picking assembly 120 is received within docking module 140. Dislodging fingers 154 are configured (or angled) to remove the golf balls that are wedged between adjacent resilient discs 122 when picking assembly 120 and dislodging fingers 154 are rotated relative to each other around axle 124.

In the embodiments shown in FIG. 5, dislodging fingers 154 are fixed, and picking assembly 120 is rotated relative dislodging fingers 154 by rotational engagement with driving rollers 148. In such an embodiment, rotation of picking assembly 120 with respect to fixed dislodging fingers 154 provides a means for removing golf balls 174 from the picking assembly 120.

In other embodiments, however, dislodging fingers 154 could be mechanically rotated around picking assembly 120, which would remain fixed relative to the rest of docking module 140. In such embodiments, rotation of dislodging fingers 154 around the fixed picking assembly provides another means for removing the golf balls from picking assembly 120.

In yet other embodiments, resilient discs 122 could engage grooves (not shown) forming part of docking module 140. The grooves could be configured to temporarily increase the physical space between resilient discs 122 in order to allow the golf balls to be dislodged from the therebetween. Accordingly, in such embodiments, rotation of resilient discs 122 by means of driving rollers 148 could cause resilient discs 122 to engage the grooves in such a way as to temporally increase the physical space between resilient discs 122 as resilient discs 122 are engaged with the grooves and then disengaged with the grooves, thereby providing yet another means for removing golf balls 174 from the picking assembly 120.

The spacing between adjacent dislodging fingers 154 may be, for example, between 1" and 2" depending on the spacing between adjacent resilient discs 122. Each of dislodging fingers 154 may have a diameter suitable for removing golf balls 174 that are wedged between adjacent resilient discs 122, such as 0.625". Each of dislodging fingers 154 may have a length (or protruding distance) suitable for removing golf balls 174 that are wedged between adjacent resilient discs 122, such as 5.5". Each of dislodging fingers 154 may have an angle suitable for removing golf balls 174 that are wedged between adjacent resilient discs 122, such as between 5° and 45° relative to the vertical (when on level ground).

The number of dislodging fingers 154 may be equal to the number of resilient discs 122 of picking assembly 120 but need not be. For example, picking assembly 120 may have fewer resilient discs 122 than dislodging fingers 154, in which case docking module 140 may have a guide to ensure that picking assembly 120 is docked in such a position that each of dislodging fingers 154 can engage a space between adjacent resilient discs.

Docking module 140 may have a chassis 142 that is sized and situated in such as manner as to bear the load of picking assembly 120. For example, chassis 142 may be made of various elements, such as flat bars, corners, plates, and tubular steel of 3/16" and 1/4" at various places. As will be appreciated by the skilled reader, elements of chassis 142 may be made of various combinations of materials, such as, for example, aluminum, stainless steel, titanium, or any other suitable material. Dislodging fingers 154 may be attached to or coupled to chassis 142.

Docking module 140 may include one or more driving rollers 148 (or "drums") configured to rotatably engage picking assembly 120 (e.g., when picking assembly 120 is in the docked configuration 110), thereby rotating picking assembly 120 relative to dislodging fingers 154. Driving rollers 148 may be driven by a hydraulic motor 149, rotationally coupled to a first driving roller 148 by way of gears and chain 151. First and second driving rollers 148 may also be rotationally coupled by way of gears and chain 153. As will be appreciated by the skilled reader, driving rollers 148 may be driven by any other combination of suitable means including, but not limited to, mechanical systems, pneumatic systems, and/or servomotors.

Driving rollers 148 may be, for example, rubber-coated steel tubes, rubber-coated concrete pipes or any other suitable material. Driving rollers 148 and dislodging fingers 154 may be situated on chassis 142. Driving rollers 148 and dislodging fingers 154 may be operated by controls of system 100.

In some embodiments, docking module 140 may comprise grooves configured to realign the discs during rotation of the discs by driving rollers 148.

Docking module 140 may include a winch 155 configured to pull a pulling cable 146A over a cable guide 144, so as to move picking assembly 120 along surface S and to pull picking assembly 120 into a received position within docking module 140. Picking assembly 120 in the received position within docking module 140 may be considered the docked configuration 110. Alternatively, system 100 may have winch 155 and pulling cable 146A separate from docking module 140 but with the same functionality. In some embodiments, cable guide 144 may be provided with cleaning means, such as a cleaning blade, that is configured to clean and/or cut seaweed, kelp or other material that has become attached to pulling cable 146A during operation, as pulling cable 146A is pulled through cable guide 144 by winch 155.

The winch 155 may be fixed to chassis 142 accompanied by a tower on which there is cable guide 144 to support movement of pulling cable 146A and give it the required clearance. Winch 155 may be a mechanical device that uses hydraulic (or electric) power to pulls pulling cable 146A over cable guide 144. Cable guide 144 may be designed in such a way as to allow pulling cable 146A to wind properly on the drum of winch 155. Cable guide 144 may also allow system 100 to be used at multiple angles. Cable guide 144 may be made of any suitably durable material, such as steel.

Winch 155 may be operated by controls of system 100. Winch 155 preferably has the ability to pull pulling cable 146A with sufficient speed and capacity to pull the picking assembly 120 across surface S. For example, winch 155 may be a hydraulic winch that has a capacity of 3000 pounds and a speed of about 600 feet/minute. Winch 155 may be equipped with sufficient pulling cable 146A to pull picking assembly 120 across a certain length of a desired surface S, such as 600 feet of 5/16" cable. Winch 155 may be able to provide constant tension between docking module 140 and picking assembly 120. In some implementations, there may be more than one winch. For example, there may be two winches that are substantially similar in capacity and speed. Wherever reference is made to "a winch" or "the winch", it can be understood to refer to "two winches" (or more).

As described elsewhere herein, in some embodiments, docking module 140 may comprise winch 155 for pulling cable 146A and a winch for pulling cable 146B. In such an embodiment, when pulling cable 146B is engaged with an anchored pulley at one end of surface S, successive operation of the two winches can produce movement of the picking assembly along directions D2, as shown on FIG. 4.

Docking module 140 may include a ball receptacle 150 (or "ball tank") for collecting (and storing) golf balls that are removed from picking assembly 120 by docking module 140. Alternatively, system 100 may have ball receptacle 150 separate from docking module 140 but with the same functionality. Ball receptacle 150 may have the capacity to store, for example, hundreds of balls, or even thousands of balls (e.g., 7000 balls). In some embodiments, ball receptacle 150 may have a door to empty or drain the balls therefrom. In some embodiments, ball receptacle 150 may include water drainage holes and/or slits that permit water to be drained from ball receptacle 150 while retaining balls within ball receptacle 150. In some embodiments, ball receptacle 150 may be mounted on a weight scale (not shown) configured to measure the total weight of golf balls 174 collected and/or the weight of golf balls 174 collected between subsequent dockings of picking assembly 120.

Docking module 140 may have a ramp 152 for picking assembly 120 to go up from the ground into docking module 120. Alternatively, system 100 may have ramp 152 separate from docking module 140 but capable of being positioned next to (or adjoining) docking module but with the same functionality. Ramp 152 may have an angle suitable allowing picking assembly 120 to go up from the ground into docking module 120, such as 30 degrees relative to the horizontal (when on level ground). Ramp 152 may be made of a suitable material to allow for picking assembly 120 to go up into docking module 120 smoothly, such as, for example, black Teflon™ or stainless steel.

In other embodiments, docking module 140 may comprise a boom configured to lift the picking assembly into a docked configuration in docking module 140. In yet other embodiments, picking assembly 120 can remain stationary on the ground 176 and docking module 140 can be configured to "scoop" picking assembly 120 from the ground 176 using ramp 152.

In some embodiments, docking module 140 may have an attachment member (not shown) to attach docking module 140 to vehicle 160.

In at least one embodiment, docking module 140 may be considered to be part of an apparatus for removing golf balls from picking assembly 120. As such, this apparatus may be some or all of the components and/or functionality of docking module 140 described herein. In addition, vehicle 160 may have this apparatus attached thereto.

Figure 6:
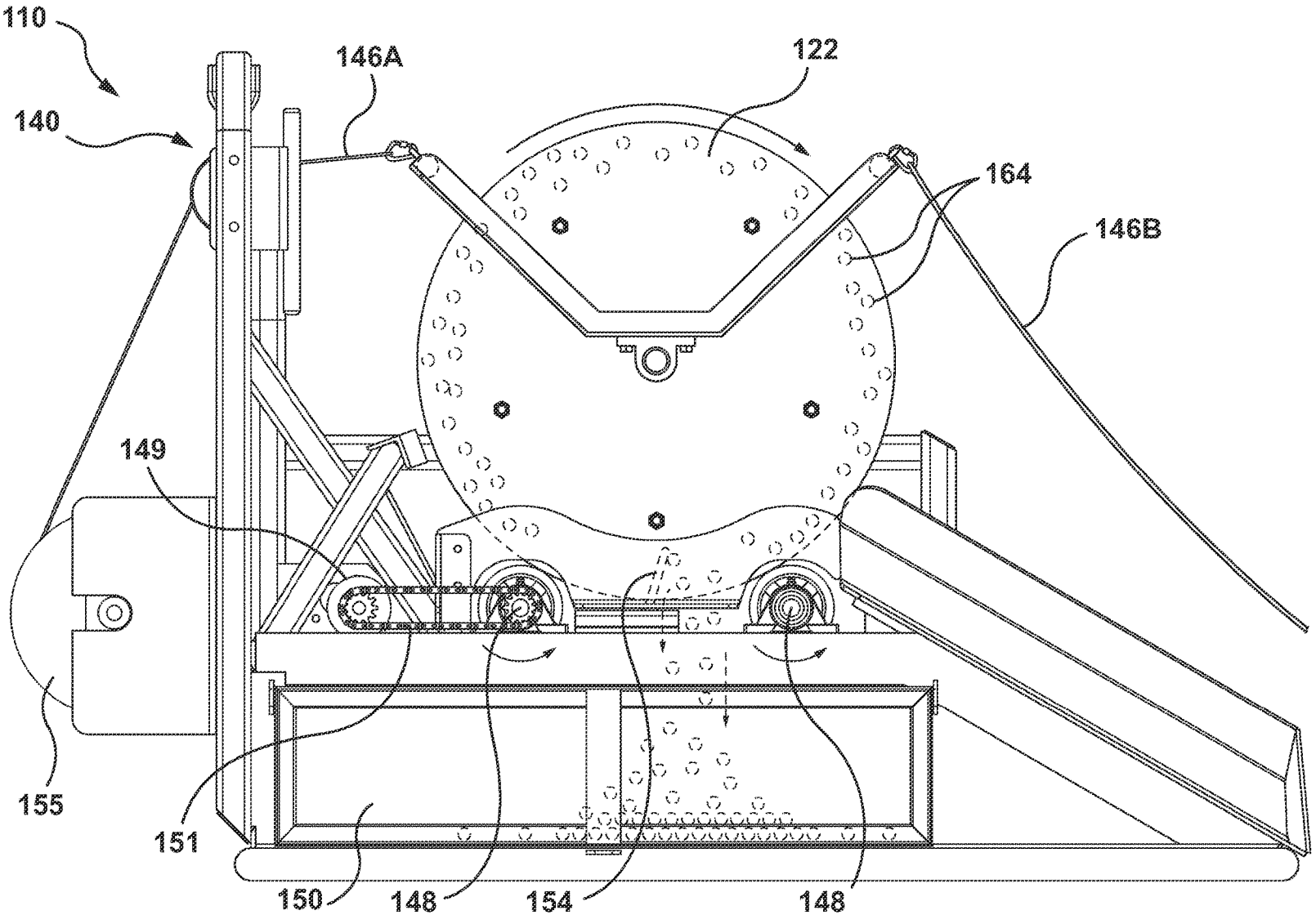
FIG. 6 shows a side view of an example embodiment of the picking assembly of FIG. 1 rotating on the docking module of the system shown FIG. 1 to dislodge golf balls into a ball receptacle.

FIG. 6 shows a side view of an example embodiment of the docked configuration 110 of FIG. 1. While in use, picking assembly 120 rotates on driving rollers 148 of the docking module 140 to dislodge golf balls into ball receptacle 150.

Figure 7:
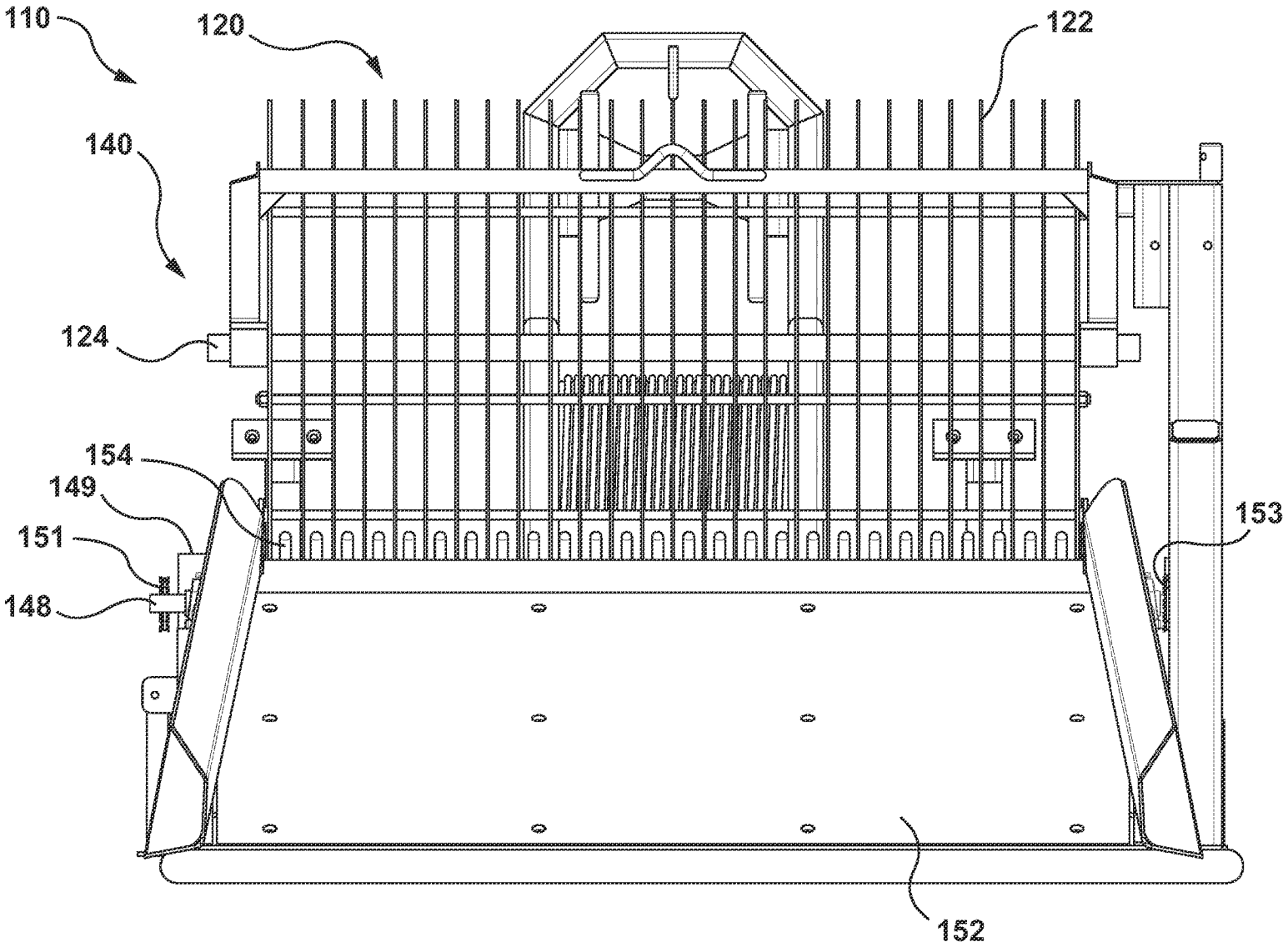
FIG. 7 shows a front view of an example embodiment of the docking module of the system shown FIG. 1, showing a pulling assembly and dislodging fingers in between adjacent discs.

FIG. 7 shows a front view of an example embodiment of the docked configuration 110 of FIG. 1. In FIG. 7, picking assembly 120 is sitting on driving rollers 148 such that each of dislodging fingers 154 is positioned inside the gaps between adjacent resilient discs 122.

FIGS. 8A-8C show side views of an example embodiment of the golf ball recovery system 100 of FIG. 1 in use. FIG. 8A shows picking assembly 120 being pulled across the ground 176. FIG. 8B shows picking assembly 120 being pulled up ramp 152 of docking module 140. FIG. 8C shows picking assembly 120 settling into a received position within docking module 140.

In FIG. 8A, pulling cable 146 pulls on picking assembly 120 towards docking module 140. Winch 155 pulls pulling cable 146A that is attached to towing bar 128 of picking assembly 120 in the direction of ramp 152.

In FIG. 8B, pulling cable 146A pulls on picking assembly 120 up ramp 152 of docking module 140. Winch 155 pulls on pulling cable 146A that is attached to towing bar 128 of picking assembly 120 up ramp 152 and onto driving rollers 148.

In FIG. 8C, picking assembly 120 settles into a received position within docking module 140. Winch 144 no longer pulls on pulling cable 146A. Picking assembly 120 sits on driving rollers 148. As picking assembly 120 is docked in docking module 140, they are in the docked configuration 110, ready to have the golf balls removed from the picking assembly, before being removed from docking module 140 by way of pulling cable 146B.

FIG. 9 shows a flowchart illustrating an example of a method 900 for recovering golf balls from a surface using golf ball recovery system 100 of FIG. 1. The surface S may be the bed of a body of water.

At step 901, the system 100 for recovering golf balls 174 is provided and the endpoints of the system are positioned between a new pair of points on sides of surface S.

In other words, a pair of geographic points on either side of surface S are selected and the endpoints of the system (e.g., vehicles 160 and 181) are positioned at such geographic points, as shown on FIG. 4.

Once the endpoints of the system are in position, at step 902, picking assembly 120 is dragged across surface S along directions D2 (see FIG. 4) using pulling cables 146A and 146B. This step may be repeated as many times as necessary to collect an appropriate number of golf balls on the section of surface S between endpoints of system 100.

Then, at step 903, picking assembly 120 is pulled into docking module 140 using pulling cable 146A, before having docking module 140 remove the golf balls from picking assembly 120, as described elsewhere herein, at step 904.

Then, at step 905, picking assembly 120 may be returned to the distal endpoint of system 100, or may simply remain in the docking module 140.

Then, at step 906, a determination is made as to whether a second pass between the same pair of geographic points is required. This determination may be based on, for example, the number of golf balls 174 collected during the previous pass. In some embodiments, when the number of golf balls 174 collected during a previous pass is sufficiently large, the pass between the same pair of geographic points is repeated. In some embodiments, the determination made at step 906 may be made by a user by means of, for example, visual inspection of picking assembly 120. In other embodiments, the determination made at step 906 may be made by automatic means, such as by automated visual inspection of picking assembly 120 using, for example, computer vision, or by automatically weighing golf balls 176 received as a result of the previous pass, as described elsewhere herein.

Once the appropriate number of passes are completed between the pair of geographic points, a determination is made as to whether the entire surface S has been covered by picking assembly 120. In some embodiments, the determination made at step 907 may be made by a user by means of, for example, visual inspection of the body of water covering surface S. In other embodiments, the determination made at step 907 may be made by automatic means, such as by a GPS-based navigation system.

If the entire surface S has been covered, then the method may be stopped. If, however, the entire surface S has not yet been covered, a determination is made as to what parts of surface S have not been covered, and a new pair of points on sides of surface S are selected so that the dragging of picking assembly 120 between this new pair of points will cover a previously uncovered part of surface S. Then, step 902 is repeated using this new pair of points.

As will be appreciated by the skilled reader, by implementing the above simple method, system 100 can eventually cover the entirety of surface S.

As will be appreciated by the skilled reader, the system, apparatus and methods of the present disclosure provide several technical advantages over the prior art. While increases in speed and efficiency of golf ball recovery will be clear to those skilled in the art, other advantages will also be apparent from an understanding of the present disclosure. For example, because picking assembly 120 can be received in a docking module 140 that is attached to vehicle 160, it is possible to configure the storage capacity of the docking module 140 to be very large. Moreover, because picking assembly 120 is pulled by way of one or more winches, the speed with which picking assembly 120 can be pulled across surface S can be adjusted for optimal speed and efficiency of golf ball recovery. Furthermore, because the entire system is mechanical, a heavier picking assembly 120 may be used, which allows the system retrieve golf balls that have been deeply buried in mud.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. A system for recovering golf balls comprising:

a picking assembly configured to pick golf balls from a surface when moved along the surface, the picking assembly comprising an axle having mounted thereon a plurality of resilient discs spaced apart from one another so as to allow the golf balls to be wedged between adjacent discs; and a docking module configured to remove the golf balls from the picking assembly only when the picking assembly is received in the docking module, the docking module comprising a plurality of dislodging fingers, each dislodging finger engaging a space between adjacent resilient discs when the picking assembly is received within the docking module, the dislodging fingers being configured to remove the golf balls that are wedged between the adjacent resilient discs when the picking assembly and the dislodging fingers are rotated relative to each other around the axle, wherein the picking assembly is configured to pick golf balls from the surface only when undocked from the docking module.

2. The system for recovering golf balls of claim 1, wherein the docking module is further arranged to collect golf balls that have been removed from the picking assembly.

3. The system for recovering golf balls of claim 2, further comprising:

a ball receptacle for storing the golf balls that are collected from the picking assembly by the docking module.

4. The system for recovering golf balls of claim 1, wherein the docking module further comprises one or more driving rollers configured to rotatably engage the picking assembly, thereby rotating the picking assembly relative to the dislodging fingers.

5. The system for recovering golf balls of claim 1, wherein the docking module is configured to momentarily increase a distance between the plurality of resilient discs when the picking assembly is rotated in the docking module in order to remove the golf balls from therebetween.

6. The system for recovering golf balls of claim 1, further comprising:

a winch configured to pull a first cable attached to the picking assembly so as to move the picking assembly along the surface and to pull the picking assembly into a received position within the docking module.

7. The system for recovering golf balls of claim 1, further comprising:

an attachment member on the docking module to attach to a vehicle configured to transport the docking module.

8. The system for recovering golf balls of claim 1, further comprising:

a counter-action device configured to pull a second cable attached to the picking assembly so as to move the picking assembly along the surface and to pull the picking assembly away from the docking module.

9. The system for recovering golf balls of claim 8, wherein the counter-action device comprises a vehicle with a winch mounted thereon to winch the second cable away from the docking module.

10. An apparatus for removing golf balls from a picking assembly configured to pick the golf balls from a surface when moved along the surface, the picking assembly comprising an axle having mounted thereon a plurality of resilient discs spaced apart from one another so as to allow the golf balls to be wedged between adjacent discs, the apparatus comprising:

a docking module configured to remove the golf balls from the picking assembly only when the picking assembly is received in the docking module, and a winch configured to pull a cable attached to the picking assembly so as to move the picking assembly along the surface and to pull the picking assembly into a received position within the docking module.

11. The apparatus of claim 10, wherein the docking module comprises a plurality of dislodging fingers, each dislodging finger engaging a space between adjacent resilient discs when the picking assembly is received within the docking module, the dislodging fingers being configured to remove the golf balls that are wedged between the adjacent resilient discs when the picking assembly and the dislodging fingers are rotated relative to each other around the axle.

12. The apparatus of claim 11, wherein the docking module is configured to momentarily increase a distance between the plurality of resilient discs when the picking assembly is rotated in the docking module in order to remove the golf balls from therebetween.

13. The apparatus of claim 10, further comprising:

one or more driving rollers configured to rotatably engage the picking assembly, allowing rotation of the picking assembly relative to the dislodging fingers.

14. The apparatus of claim 10, further comprising:

a ball receptacle for storing the golf balls that are collected from the picking assembly by the docking module.

15. A vehicle having an apparatus in accordance with claim 10 attached thereto.

16. A method of recovering golf balls from a surface comprising:

a) providing a system for recovering golf balls including a picking assembly configured to pick the golf balls from the surface when moved along the surface and a docking module configured to receive the picking assembly and to remove the golf balls therefrom, the system having two endpoints between which the picking assembly is operable to travel;

positioning the system endpoints between a pair of geographic points on sides of the surface;

dragging the picking assembly across the surface between the two endpoints using a pulling cable;

pulling the picking assembly into the docking module using the cable; and removing any golf balls collected using the docking module.

17. The method of claim 16, wherein the method further comprises:

repeating the steps of positioning, dragging, pulling and removing between different pairs of geographic points on sides of the surface until the picking assembly has been dragged across substantially the entire surface.

* * * * *